US011041291B2

(12) United States Patent
Hageman et al.

(10) Patent No.: US 11,041,291 B2
(45) Date of Patent: Jun. 22, 2021

(54) CONTROLLING A WORK MACHINE BASED ON SENSED VARIABLES

(71) Applicant: Deere & Company, Moline, IL (US)

(72) Inventors: John M. Hageman, Dubuque, IA (US); Tarik Loukili, Johnston, IA (US); David J. Kaney, Bettendorf, IA (US)

(73) Assignee: Deere & Company, Moline, IL (US)

( * ) Notice: Subject to any disclaimer, the term of this patent is extended or adjusted under 35 U.S.C. 154(b) by 313 days.

(21) Appl. No.: 16/131,849

(22) Filed: Sep. 14, 2018

(65) Prior Publication Data

US 2020/0087893 A1 Mar. 19, 2020

(51) Int. Cl.

| | |
|---|---|
| ***E02F 9/26*** | (2006.01) |
| ***E02F 9/24*** | (2006.01) |
| ***E02F 9/20*** | (2006.01) |
| ***E02F 3/43*** | (2006.01) |
| ***E02F 3/32*** | (2006.01) |

(52) U.S. Cl.

CPC ..... *E02F 9/26* (2013.01); *E02F 3/32* (2013.01); *E02F 3/435* (2013.01); *E02F 9/20* (2013.01); *E02F 9/24* (2013.01)

(58) Field of Classification Search

CPC ..... E02F 9/26; E02F 3/32; E02F 3/435; E02F 9/20; E02F 9/24

See application file for complete search history.

(56) References Cited

U.S. PATENT DOCUMENTS

| | | | | |
|---|---|---|---|---|
| 3,085,583 A | | 4/1963 | Siek | |
| 6,225,574 B1 * | | 5/2001 | Chang | G01G 23/002 177/139 |
| 8,838,331 B2 | | 9/2014 | Jensen | |
| 8,930,091 B2 | | 1/2015 | Upcroft et al. | |
| 2008/0005938 A1 * | | 1/2008 | Aebischer | E02F 9/26 37/413 |

(Continued)

FOREIGN PATENT DOCUMENTS

| | | | | |
|---|---|---|---|---|
| WO | WO-2005103396 A1 * | 11/2005 | | E02F 3/435 |
| WO | 2016159839 A1 | 10/2016 | | |
| WO | 2017184037 A1 | 10/2017 | | |

OTHER PUBLICATIONS

German Search Report issued in counterpart application No. 102019214032.7 dated May 26, 2020 (10 pages).

*Primary Examiner* — Hunter B Lonsberry
*Assistant Examiner* — Elizabeth Yang
(74) *Attorney, Agent, or Firm* — Joseph R. Kelly; Kelly, Holt & Christenson PLLC

(57) ABSTRACT

A mobile work machine includes a frame and a ground engaging element movably supported by the frame and driven by an engine to drive movement of the mobile work machine. The mobile work machine includes a container movably supported by the frame, the container configured to receive contents and an actuator configured to controllably drive movement of the container relative to the frame. The mobile work machine includes a control system configured to generate an actuator control signal, indicative of a commanded movement of the actuator, and provide the actuator control signal to the actuator to control the actuator to perform the commanded movement and a content density determination system, communicatively coupled to the control system, configured to determine a density of the contents of the container.

16 Claims, 7 Drawing Sheets

(56) References Cited

U.S. PATENT DOCUMENTS

| | | | | |
|---|---|---|---|---|
| 2010/0245542 | A1 | 9/2010 | Kim et al. | |
| 2014/0291038 | A1 | 10/2014 | Hugue et al. | |
| 2018/0087240 | A1* | 3/2018 | Schmitt | E02F 3/437 |
| 2018/0106709 | A1 | 4/2018 | Cherney | |
| 2018/0239849 | A1 | 8/2018 | Martinsson et al. | |
| 2018/0245308 | A1* | 8/2018 | Ready-Campbell | E02F 3/964 |
| 2018/0258608 | A1* | 9/2018 | Uetake | E21C 27/30 |
| 2019/0093321 | A1* | 3/2019 | Hiekata | E02F 9/264 |
| 2020/0011029 | A1* | 1/2020 | Sano | G01G 19/083 |
| 2020/0095751 | A1* | 3/2020 | Nishimura | E02F 9/26 |
| 2020/0283992 | A1* | 9/2020 | Nakamura | E02F 3/32 |
| 2020/0407949 | A1* | 12/2020 | Aizawa | E02F 3/301 |

* cited by examiner

CONTROLLING A WORK MACHINE BASED ON SENSED VARIABLES

FIELD OF THE DESCRIPTION

The present disclosure relates generally to devices for use in earth-moving operations. More specifically, but not by way of limitation, this disclosure relates to determining the volume and/or weight of contents in a container of a work machine.

BACKGROUND

Operating a work machine, such as an excavator, loader, dump truck or a scraper, is a highly personal skill. Efficiency—e.g., amount of earth moved by the work machine over an amount of time—is one way to measure at least part of that skill. Efficiency is also one way to measure the performance of the particular machine. Measuring efficiency with accuracy and without interjecting an additional step on moving the earth is difficult. For instance, weighing contents of the bucket of an excavator can interject additional steps that may cause the overall earth-moving process to be less efficient. Processes used to determine the amount of contents in the bucket without physical contact with the bucket may not accurately estimate the volume of the contents.

The discussion above is merely provided for general background information and is not intended to be used as an aid in determining the scope of the claimed subject matter.

SUMMARY

A mobile work machine includes a frame and a ground engaging element movably supported by the frame and driven by a power source to drive movement of the mobile work machine. The mobile work machine includes a container movably supported by the frame. The container is configured to receive contents and an actuator is configured to controllably drive movement of the container relative to the frame. The mobile work machine includes a control system configured to generate an actuator control signal, indicative of a commanded movement of the actuator, and provide the actuator control signal to the actuator to control the actuator to perform the commanded movement. A content density determination system is communicatively coupled to the control system and is configured to determine a density of the contents of the container.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
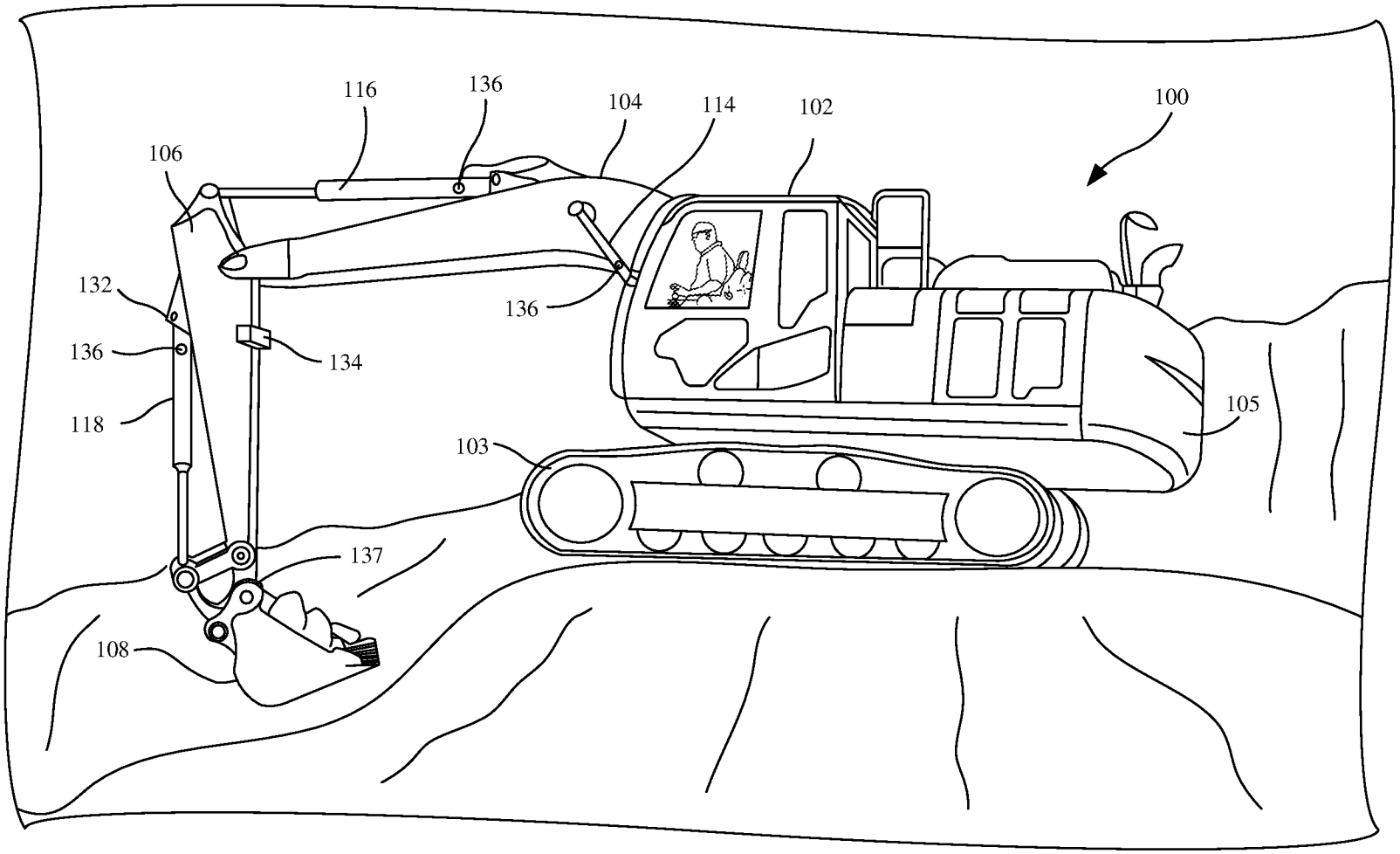
FIG. 1 is a side view showing one example of a work machine.

In an earth moving operation, the performance or efficiency of a work machine or operator can be measured by recording the volume and/or weight of the material moved throughout the operation. For instance, information regarding the volume and/or weight of the material moved throughout the operation can help the operator make decisions or bill their more accurately. In automatic control systems of a work machine, the volume and/or weight of the material moved through operation can be used as feedback to the control system. While sensor systems exist that can sense either the volume or weight of material being moved by a work machine, they are not without limitation.

For instance, weighing sensor systems may have inaccuracies during machine movement which is typically resolved by momentarily stopping a machine movement and then sensing a weight of the contents. However, because of this momentary stop, the operation is less efficient. To solve this inaccuracy without the resulting inefficiency, the weight of the contents can be determined by sensing the volume of the contents and multiplying the volume of the contents with an estimated density to estimate the weight or mass of the contents.

Additionally, volume sensor systems may have inaccuracies during some periods of a dig cycle. Some volume sensors, for example, are optical. However, when the volume sensor's view of contents are obstructed, an optical sensor encounters difficulty and inaccuracy. It is often true that when an earth moving machine (such as an excavator) is operating, the density of the earth does not change quickly over time. The type of earth being moved is often similar, for example, from one dig operation to the next (and over many dig operations) at the same worksite. Therefore, the present description describes a calibration process in which volume and weight measurements are taken, for a calibration time period, so that a relatively accurate density estimate of material being moved is obtained. Then, the weight or volume of material moved over multiple dig operations can be accurately estimated using only volume measurements, or weight measurements, respectively.

Certain examples and features of the present disclosure relate to determining a density, volume or weight of earth in a container of a work machine, such as a bucket of an excavator. The system can include a volume sensor (which can include a three-dimensional—3D sensor, such as a stereo camera or a laser scanner, and an angle sensor, such as a potentiometer, inertial measurement unit or linear displacement transducer) and a weight sensor (such as a hydraulic pressure sensor).

To sense a weight, the weight sensor can determine a hydraulic pressure required to support the bucket and its contents. The hydraulic pressure typically is indicative of the total weight supported by the hydraulic cylinder. However, since the machine components have known weights and geometries they can be factored out of the total weight resulting in a reliable weight of the contents in the bucket.

To sense a volume, one example process can include measuring 3D points, with the 3D sensor, that represent the surface of material carried by the container of a work machine. The 3D points that correspond to the material carried by the container can be determined and the 3D points that correspond to the container itself can be determined. The volume of material can be calculated using the 3D points corresponding to the material carried by the container using (i) the orientation or location of the carrier relative to the sensor and (ii) a 3D shape of the container. For example, the volume can be calculated as a difference in the surface of the material in the bucket from a reference surface (e.g., the bucket strike plane or bucket interior) that represents a known volume.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure. For example, while this disclosure describes measuring contents in the bucket of an excavator, the contents could be in the container of any capable work machine, such as a front loader, a scraper, loader, dump truck below-ground mining equipment, or other type of machine, etc.

FIG. 1 is a side view showing one example of a work machine 102 in a worksite 100. Work machine 102 includes ground engaging elements 103 (e.g. tracks), boom 104, house 105, stick 106, and bucket 108. Ground engaging elements 103 engage a surface of worksite 100 to drive and direct motion of work machine 102 across worksite 100. House 105 is rotatably coupled to ground engaging elements 103 and typically houses the frame, an engine, transmission, hydraulic pumps, an operator compartment, controls for controlling work machine 102, etc.

Boom 104 is coupled to house 105 at a linkage point that allows movement of boom 104 relative to house 105. Boom 104 is actuated by an actuator 114. Stick 106 is coupled to boom 104 at a linkage point that allows movement of stick 106 relative to boom 104. Stick 106 is actuated by actuator 116. Bucket 108 is coupled to stick 106 at a linkage point that allows movement of bucket 108 relative to stick 106. Bucket 108 is actuated by actuator 118.

The position or angle of bucket 108 can be monitored by a bucket sensor 132. As shown, bucket sensor 132 is a linear displacement transducer (LDT) coupled to actuator 118, which is, itself, couple to bucket 108. However, bucket sensor 132 could also be a potentiometer at a linkage point between bucket 108 and stick 106 or some other type of position/angle sensor. Work machine 102 can also include a 3D sensor 134. 3D sensor 134, as shown, is a stereo camera coupled to stick 106 and captures images of the bucket 108. Using images captured by 3D sensor 134 and an angle determined by bucket sensor 132 the surface of the contents in the bucket can be identified and, from that, a volume of contents in the bucket 108 can be determined. 3D sensor 134 is not limited to an image sensor and could be a laser-based sensor or other 3D sensor as well. A more in-depth example of volume determination is explained in greater detail with respect to FIG. 5A.

Work machine 102 can also include one or more pressure sensors 136. As shown, there is a pressure sensor 136 on each of the actuators 114, 116 and 118. However, in other examples, there may be more or less pressure sensors 136. Pressure sensors 136 can detect the hydraulic pressure applied to an actuator. Based on the hydraulic pressure applied to the actuator a weight of the components supported by a given actuator can be determined. Further, the weight of the contents in the bucket 108 can be determined by removing the pressure contribution of the various machine components to the sensed total pressure. The contribution to the overall pressure value of the components can be determined using known machine parameters (e.g., machine component weights, geometries, current position, etc.). A more in-depth example of this weight determination is explained in greater detail with respect to FIG. 5B.

Figure 2:
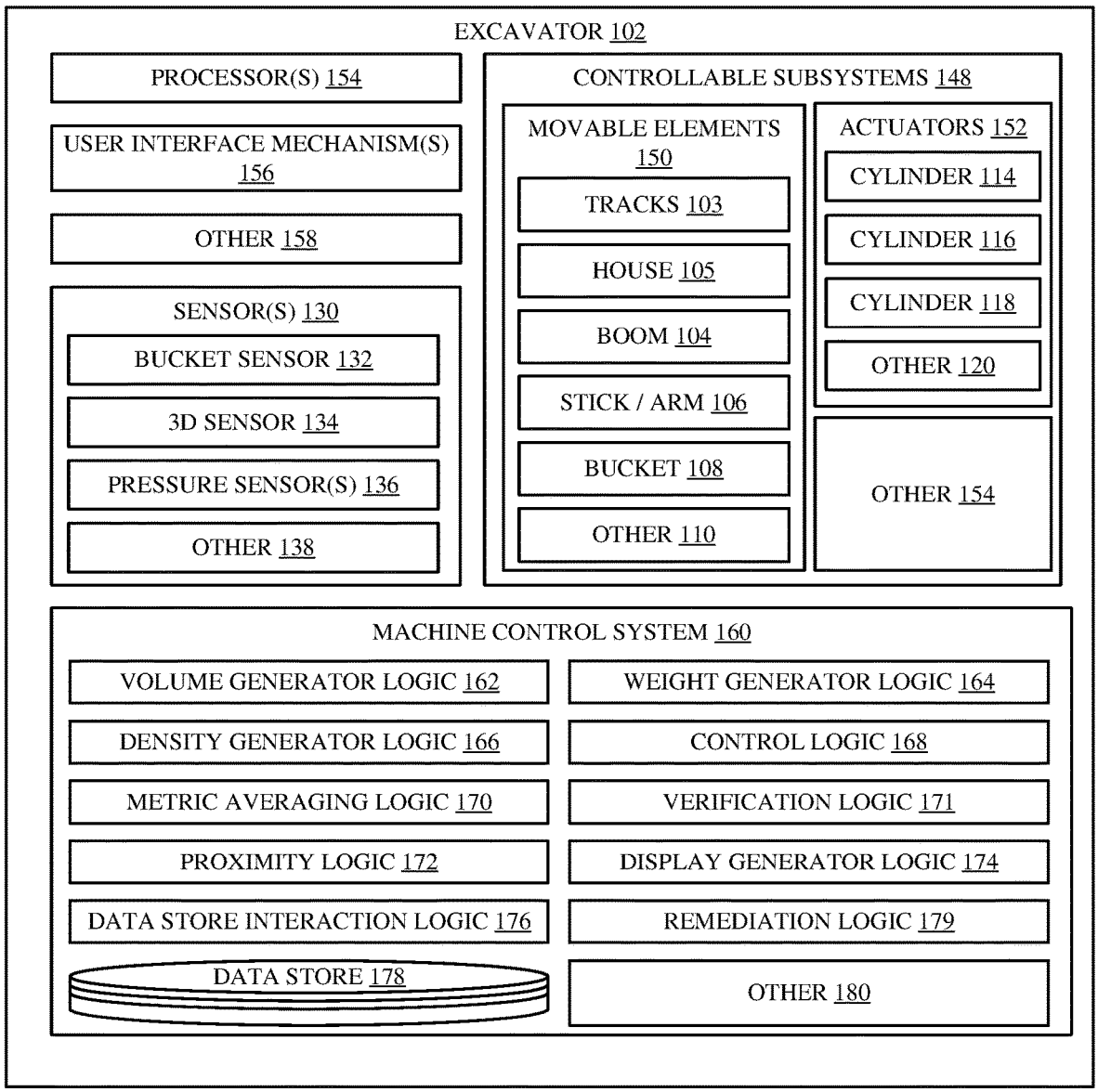
FIG. 2 is a block diagram showing one example of the work machine illustrated in FIG. 1.

FIG. 2 is a block diagram showing one example of a work machine 102. As shown, work machine 102 includes sensors 130, controllable subsystems 148, processors 154, user interface mechanisms 156, machine control system 160 and can include other items as well, as indicated by block 158.

Sensors 130 include bucket sensor 132, 3D sensor 134, pressure sensors 136 and can include other sensors as well, as indicated by block 138. Bucket sensor 132 senses a position or angle of bucket 108 relative to stick 106 (and/or relative to 3D sensor 134). Bucket sensor 132, in one example, can comprise a linear displacement transducer (LDT) on actuator 118, such as a hall effect sensor to determine the angle of bucket 108. Bucket sensor 132, in another example, can comprise a potentiometer to determine the angle of bucket 108. Bucket sensor 132 can also be a different type of sensor as well such as, but not limited to, an inertial measurement unit (IMU), gyroscope, etc.

3D sensor 134 captures images (or data) of contents in bucket 108 that are, at least in part, indicative of a volume of the contents. For example, stereo images from 3D sensor 134 can be processed to generate a 3D point cloud that is compared to a model of bucket 108, (the model can be selected or modified based on an angle value from bucket sensor 132) to determine a volume of the contents. In another example, 3D sensor 134 includes a lidar array that senses heights and volumes of points that correspond with the contents in bucket 108.

Pressure sensors 136 are coupled to one or more actuators 152 to sense a pressure in an actuator 152. A weight of contents in the bucket 108 can be accurately calculated with pressure sensor 136 by knowing some machine parameters. For example, a pressure sensor 136 coupled to actuator 114 is indicative of the pressure needed to support boom 104 and, due to coupling, vicariously support stick 106, bucket 108 and the contents of bucket 108. If the locations, angles, weights and/or centers of gravity (or weight distributions) of boom 104, stick 106 and bucket 108 are known, their contribution can be derived from the total pressure measurement from pressure sensor 136, which leaves only the pressure contribution of the weight of the contents. Once the pressure contribution of the weight is known, a pressure-to-weight conversion can be done to obtain the weight of the contents. The locations and angles of these components (boom 104, stick 106, bucket 108, etc.) can be sensed by position sensors 137. Position sensors 137 can comprise potentiometers, LDT's, IMU sensors, etc. This is just one example of weight calculation using pressure sensor 136, and more complicated methods can also be used.

Controllable subsystems 148 include movable elements 150 and actuators 152. Each movable element 150 has one or more actuators 152 that actuate or move movable element 150. As shown movable elements 150 include ground engaging elements 103, boom 104, house 105, stick 106, bucket 108 and can include other elements as well, as indicated by block 110. Illustratively, boom 104 is actuated by actuator 114, stick 106 is actuated by actuator 116, and bucket 108 is actuated by actuator 118. Commonly, actuators 152, on a work machine 102 that is an excavator, are hydraulic cylinders, however, they can be another type of actuator as well. Actuators 152 can receive signals from machine control system 160 to actuate their given movable element 150.

Machine control system 160 illustratively includes volume generator logic 162, weight generator logic 164, density generator logic 166, control logic 168, metric averaging logic 170, verification logic 171, proximity logic 172, display generator logic 174, data store interaction logic 176, data store 178, remediation logic 179, and can include other items as well, as indicated by block 180. The functions of these components will be described in greater detail with respect to FIGS. 3, 4, and 6.

Briefly, volume generator logic 162 receives sensor signals from bucket sensor 132 and 3D sensor 134, and calculates a volume metric and generates a volume metric signal indicative of the calculated volume metric.

Weight generator logic 164 receives a sensor signal from pressure sensor 136, a sensor signal from one or more position sensors 137 and machine parameter data from data store 178 using data store interaction logic 176. Weight generator logic 164 then calculates a weight of the contents in the bucket 108 based on these received values. For instance, machine parameter data retrieved from data store 178 can comprise machine component data, (e.g., mass of the components, ranges of motion of the components, dimensions of the components, center of gravity of the components, etc.). Using the machine parameter data with the position sensors signals from sensors 137, a contribution of the components to the pressure detected by pressure sensor 136 can be determined. This contribution is deducted from the total pressure detected by pressure sensor 136, leaving the remaining pressure as the contribution of the weight of the bucket contents. Using the position data received from position sensors 137, the pressure contribution by the weight of the contents can be converted into the weight of the contents. A weight metric signal is generated and is indicative of this weight.

Density generator logic 166 determines a density of the contents based on a volume metric received from volume generator logic 162 and a weight metric received from weight generator logic 164.

Control logic 168 generates control signals that, when sent to an actuator 152, cause an actuation of actuator 152. Control logic 168 can be operationally coupled to user interface mechanisms 156. User interface mechanisms 156 can include steering wheels, levers, pedals, display devices, user interfaces, etc. For example, when an operator interacts with a user interface mechanism 156, control logic 168 can generate a control signal to perform the operator indicated action. Control logic 168 may also be coupled to density generator logic 166, such that a calculated density metric can change operation of actuators 152 or work machine 102 as a whole.

For example, a work machine 102 may be loading a container that has a maximum weight limit, and based on a density and volume metric, control logic 168 determines that the current contents in bucket 108, if deposited in the container, will exceed the maximum weight limit. Accordingly, control logic 168 can prevent work machine 102 from depositing the contents in the container. In another example, the density metric is used in conjunction with either a weight metric or volume metric for feedback loop control of work machine 102. For instance, a work machine 102 running in an automatic mode may need to know either the volume or weight of contents currently being moved. However, if one of these metrics is unavailable to be sensed, the other available metric can be used in conjunction with the density metric to estimate or determine the unavailable metric.

Metric averaging logic 170 determines an average density during a worksite operation. For instance, as work machine 102 operates in a worksite over time, an average density can be calculated. The average density can be used in future calculations, in place of a calculated density, as an assumed density.

Proximity logic 172 monitors time and location during an average density calibration and operation of work machine 102. As an example, a calculated average density may only be useful for a given location. For instance, a first location may comprise a first material (e.g., rocks) and a second location may comprise a second material of different density (e.g., sand). Therefore, the average density calculated at the first location may not be useful at the second location or vice versa. As another example, a calculated average density may only be useful for a given period of time. For instance, density of contents at a given location measured at a first time can be different than the density of contents measured at the same location at a second time (due to e.g., rain, moisture changes, compaction, new contents being loaded at the same location, etc.) Therefore, the average density calculated at a first time may not always be useful for a second time even if they are at the same location. Proximity logic 172 can also set threshold values of proximity (e.g., time or location). For instance, proximity logic 172 may indicate that if work machine 102 moves a threshold distance away from where a first average density was calculated, a new average density may have to be calculated since the first calculated density may no longer be valid at the new location.

Display generator logic 174 can generate a user interface and display the user interface on a user interface mechanism 156. For example, display generator logic 174 generates a user interface that includes an indication of one or more of: the weight metric, volume metric and density metric, and displays the user interface on a display in a cab of work machine 102. A user interface generated by display generator logic 174 can include other indicators as well, such as but not limited to, the operator productivity, total moved contents in weight or volume, (over a period of time over a number of dig cycles, for this operator, over a shift, etc.) current material being moved, historic data, etc.

Data store interaction logic 176 illustratively interacts with data store 178. Data store interaction logic 176 can store or retrieve data from data store 178. For example, data store interaction logic 176 retrieves machine parameters from data store 178 and sends this data to weight generator logic 164, volume generator logic 162, etc. Data store interaction logic 176 can also store calculated average density values in data store 178.

Figure 3:
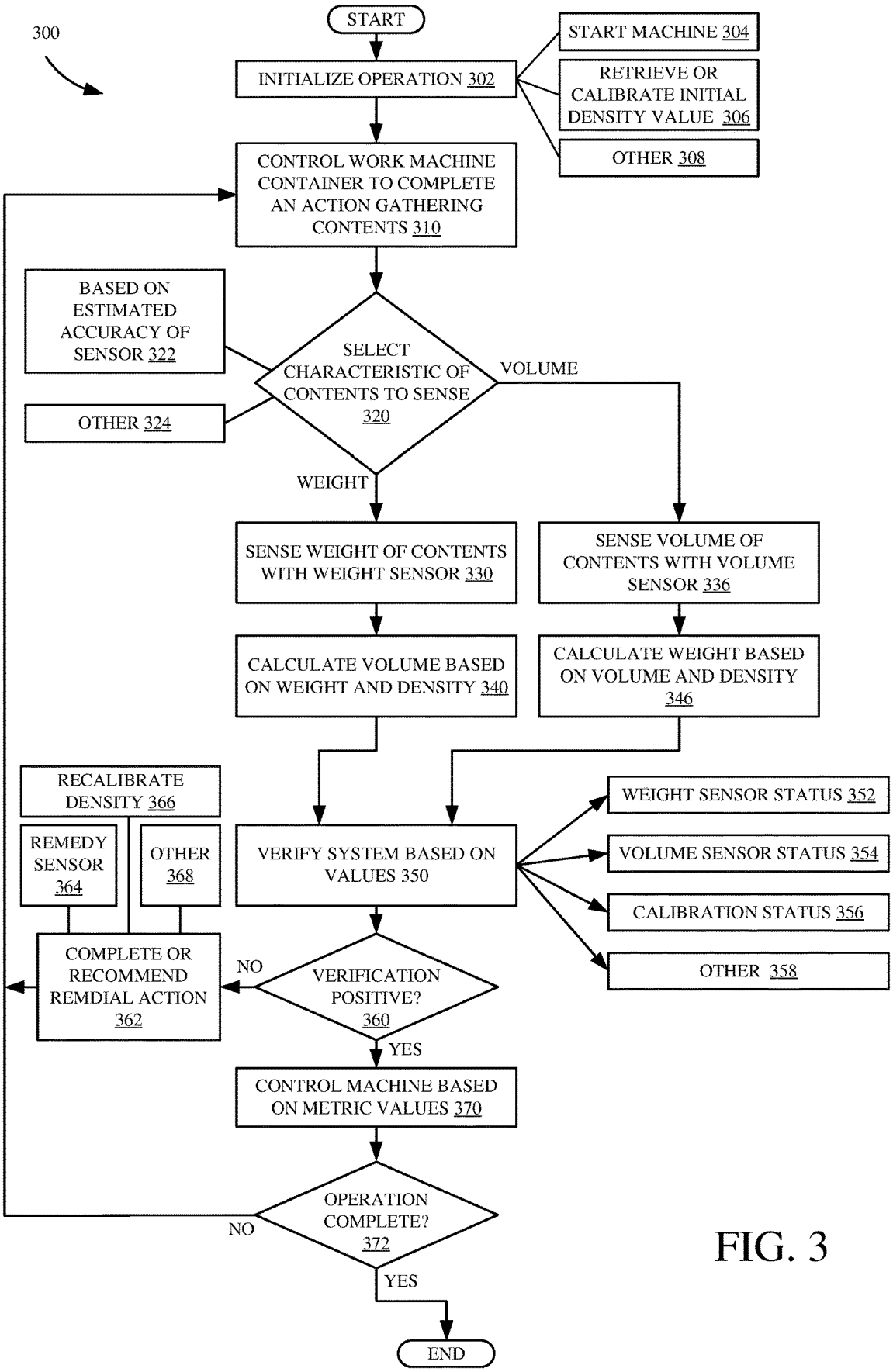
FIG. 3 is a flow diagram showing an example earth moving operation of the work machine at a worksite.

FIG. 3 is a flow diagram showing an example operation 300 of work machine 102 at a worksite. Operation 300 begins at block 302 where a machine operation initializes. As indicated by block 304, machine initialization can include. starting machine 102. As indicated by block 306, initialization can comprise retrieving a density value from data store 178 or using density generator logic 166 to calibrate an initial density value. An example density calibration operation is explained in greater detail with respect to FIG. 6. Other initialization steps may be completed at block 302 as well, as indicated by block 308.

Operation 300 proceeds at block 310 where the work machine container is controlled, by control logic 168, to complete an action of gathering contents. For example, bucket 108 performing a dig operation to scoop a load of gravel.

At block 320, machine control system 160 determines a characteristic (e.g., weight or volume) to be sensed. In one example, the characteristic can be selected based on an estimated accuracy of the sensor that will be sensing it, as indicated by block 322. For instance, during an active dig cycle (e.g., where bucket 108 is gathering and moving a load of contents) the accuracy of a volume sensing camera (e.g., 3D sensor 134) may be determined to be more accurate than a weight sensor (e.g., pressure sensor 136) and thus the volume is the selected characteristic to be sensed. In another example, bucket 108 may be stationary or moving but view of the contents in bucket 108 is obscured from the view of the volume sensing camera. In this instance the weight sensor may be more accurate than the volume sensor, and thus, the weight is the selected characteristic to be sensed. After the characteristic is selected, operation 300 proceeds at either block 330 or 336 depending on which characteristic was selected.

If weight was the selected characteristic, operation 300 proceeds at block 330 where the weight of the contents are sensed with a weight sensor (e.g., pressure sensor 136, but the weight sensor can be one or more of the sensors 130, discussed above.). An example of sensing the weight of the contents is described below in greater detail with respect to FIG. 5A. Operation 300 then proceeds at block 340, where a volume is calculated based on the sensed weight from block 330 and the density value obtained as discussed above with respect to block 306. Volume can be calculated simply by dividing the weight by the density or in more complex ways as well.

If volume was the selected characteristic, operation 300 proceeds at block 336 where the volume of the contents are sensed with a volume sensor (e.g., 3D sensor 134). An example of sensing the volume of the contents is described below in greater detail with respect to FIG. 5B. However, the volume sensor can be one or more of the sensors 130, discussed above. Operation 300 then proceeds at block 346 where a weight is calculated based on the sensed volume in block 336 and the density value. Weight can be calculated simply by multiplying the volume by the density or in more complex ways as well.

Operation 300 then re-converges and proceeds at block 350 where an operation status is verified based on the calculated and sensed variables from blocks 330-346. An example verification operation, illustrated here by block 350, is described in greater detail with respect to FIG. 4. At block 350, the functionality of the weight sensor may be verified as indicated by block 352. For instance, if a calculated volume is a threshold distance away from an expected volume and the density value is known with some certainty to be correct, then it can be inferred that the weight sensor system is malfunctioning or needs to be calibrated. At block 350, the functionality of the volume sensor may be verified, as indicated by block 354. For instance, if a calculated weight is a threshold distance away from an expected weight and the density value is known with some certainty to be correct, then it can be inferred that the volume sensor system is malfunctioning or needs to be calibrated. At block 350, the density calibration may be verified, as indicated by block 356. For instance, if a sensor is known to be functioning and the calculated metric is a threshold distance away from an expected metric, then it can be inferred that the density value, used in calculation, may no longer be accurate for the contents in the bucket and a new density calibration operation may be needed. An example of a density calibration is described in greater detail with respect to FIG. 6. Other verification operations may be completed as well in block 350, as indicated by block 358.

Operation 300 then proceeds at block 360 where it is determined whether the verifications completed in block 350 were positive or negative. If the verifications were negative, operation 300 proceeds at block 362 where a remedial action is completed or recommended by remediation logic 179. As indicated by block 364, if it is determined that the sensor is malfunctioning, replacing or repairing the sensor is a possible remedial action. As indicated by block 366, if the sensors are in working condition, recalibrating the density is a possible remedial action. Of course, there can be other remedial actions as well, as indicated by block 368.

If the verifications were positive, operation 300 proceeds at block 370 where the machine is controlled based on the calculated and sensed metric values. For instance, in some control systems weight and/or volume are used as feedback in a feedback control system.

At block 372, it is determined whether the operation is complete. If there are no more operations to complete, then operation 300 is complete. If there are more operations to complete, then operation 300 continues again at block 310.

Figure 4:
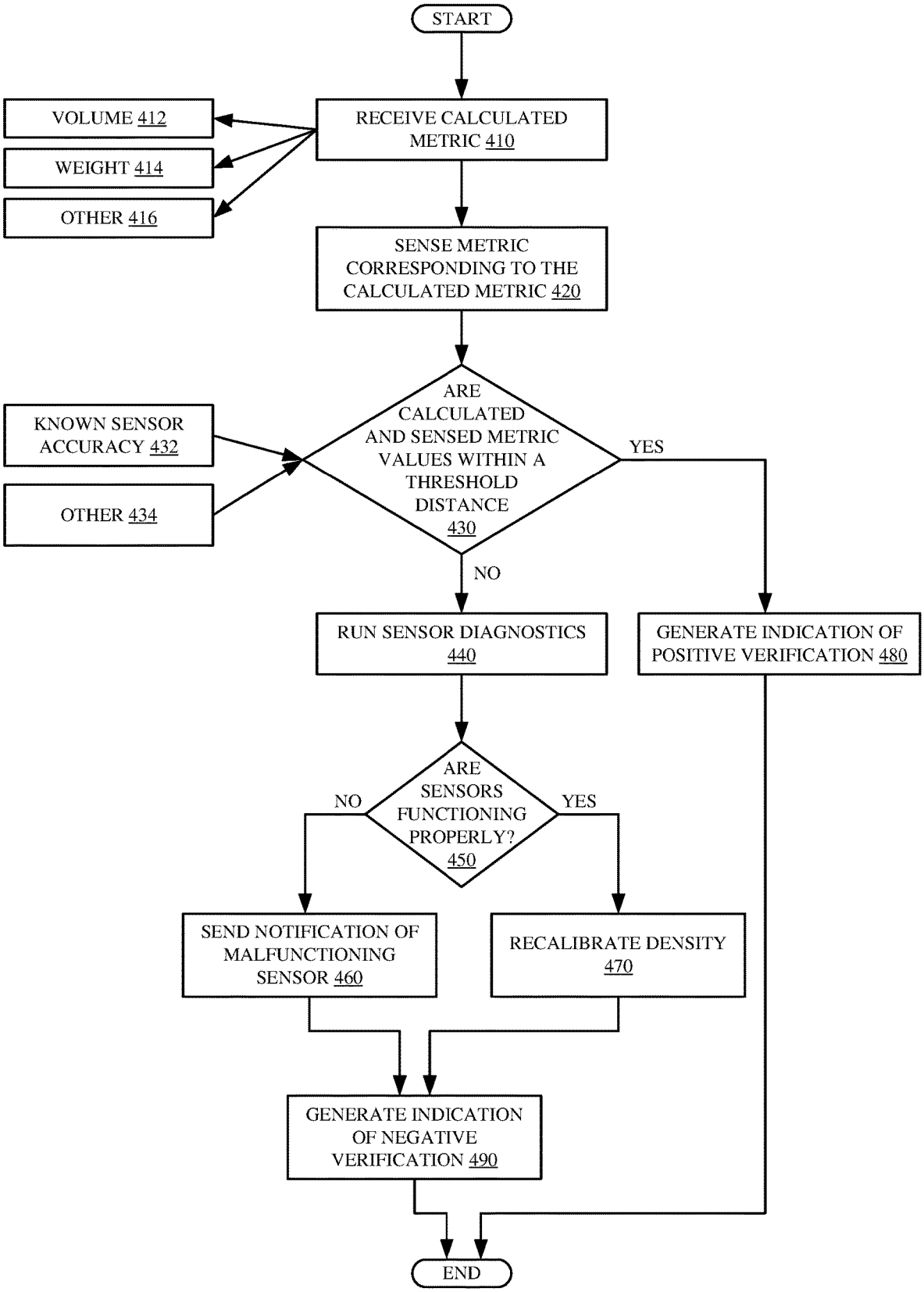
FIG. 4 is a flow diagram showing an example verification operation.

FIG. 4 is a flow diagram showing an example operation 400 of verification logic 171. Operation 400 begins at block 410 where verification logic 171 receives a calculated metric. In one example, verification logic 171 receives a volume metric (e.g., a volume calculated in block 340 of FIG. 3) as indicated by block 412. In another example, verification logic 171 receives a weight metric (e.g., a weight calculated in block 346 in FIG. 3) as indicated by block 414. Verification logic 171 can receive a different calculated metric as well, as indicated by block 416.

Operation 400 then proceeds at block 420, where the metric received in block 410 is sensed by a sensor. For instance, if the contents metric received in block 410 was volume, then at block 420, a volume sensor (such as 3D sensor 134 above) senses the volume of the contents.

Next at block 430, it is determined whether the calculated and sensed metric values are within a threshold distance of each other. The threshold distance may correspond to a known/estimated sensor accuracy or error threshold (of the sensor used in block 420), as indicated by block 432. For instance, in some cases a sensor may not be accurate given the current time in a dig cycle (e.g., a hydraulic weight sensor may not be accurate while a bucket of an excavator is moving or a volume sensor may not be accurate if its view of the contents is obstructed). In this case, the threshold distance corresponds to an estimated error of the hydraulic weight sensor given the fact that the bucket is in motion or the threshold distance corresponds to an estimated threshold or error of the volume sensor given the fact the view of the contents is obstructed. The threshold distance may correspond to another value as well, as indicated by block 434.

If the calculated and sensed metric values are within a threshold distance at block 430, then operation 400 proceeds at block 480, where an indication of positive verification is generated. The indication of positive verification can be returned to the operation that called operation 400 and then operation 400 is complete.

If a calculated and sensed metric values are not within threshold distance at block 430, then operation 400 proceeds at block 440. At block 440, sensor diagnostics are run on both the first sensor (e.g., the sensor of either block 330 or 336 in FIG. 3) and second sensor (e.g., the sensor of block 420 in FIG. 4). The diagnostics may be one of a variety of known sensor diagnostics. Some diagnostics may be more processor intensive than others and an example potential advantage of operation 400 is that intensive diagnostics need only be run, if it is determined the calculated and sensed metric values are not within a threshold distance of each other (e.g., at block 430).

At block 450, verification logic 171 determines whether the sensors are functioning properly. If the sensors are not functioning properly, operation 400 proceeds at block 460 where a notification of the malfunctioning sensor is generated. If the sensors are functioning properly, operation 400 proceeds at block 470, where the density is recalibrated. An example of density calibration is explained in greater detail with respect to FIG. 6.

At block 490, an indication of negative verification is generated by verification logic 171. The indication of negative verification can be returned to the operation that called operation 400. The indication can contain an error identifier as well. For example, it may include an identifier indicative of a malfunctioning sensor such that when the negative verification is received a remedial action to fix the sensor can be taken.

Figure 5A:
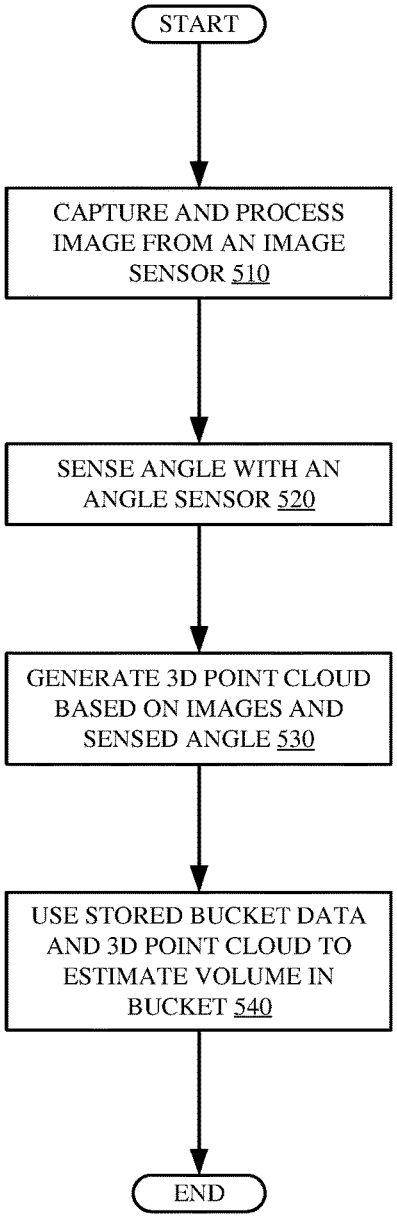
FIG. 5A is a flow diagram showing one example operation of a sensor sensing volume of contents in a container.

FIG. 5A is a flow diagram showing one example operation 500 of a sensor sensing volume of contents in bucket 108. Operation 500 begins at block 510 where an image is captured by 3D sensor 134 and processed by volume generator logic 162. In an example where 3D sensor 134 is a stereo image system, sensor 134 captures left-eye images and right-eye images of a field of view that includes bucket 108 and its contents. Volume generator logic 162 then performs stereo processing on the captured images to determine depth information based on the disparity between left-eye images and the right-eye images. For example, the images may be time stamped and a left-eye image and a right-eye image sharing the same time stamp can be combined to determine the depth information represented by the disparity between the images.

At block 520, bucket sensor 132 senses an angle of the bucket 108 (or other container) relative to the 3D sensor 134. However, in one example, the angle can be determined based on the image captured by 3D sensor 134.

At block 530, volume generator logic 162 generates a 3D point cloud of the bucket 108 (or other container) and its contents, based on the image captured in block 510. For example, volume generator logic 162 transforms or generates a model of bucket 108 using camera calibration information, an existing bucket model or template (from data store 178), and an angle value from sensor 132. The bucket model may be transformed or generated in a calibration stage, such as by using images of an empty bucket from the camera calibration information to modify or transform an existing bucket model or template of a bucket model, in addition to the angle from the sensor 132.

Then, a grid map of a 3D point cloud is updated using stereo or disparity images, captured by the 3D sensor 134, of bucket 108 with contents in it. The grid map can be updated with each new image frame that is captured by the camera. For each point in the grid map, a look-up table is used that defines bucket limits, as transformed with the bucket angle. The look-up table can be used, for example, in a segmenting process to identify the points from the grid map that are in bucket 108, as opposed to points representing bucket 108 itself, background images, or speckle artifacts (dust, etc.) in the image data. For each point in the grid map that is identified as a point that is in bucket 108, the height associated with that point can be determined. In one example, the height for a point can be determined using the model of bucket 108 to determine depth information of a point positioned in a particular location in bucket 108.

At block 540, volume generator logic 162 retrieves a reference 3D point cloud of bucket 108 in an empty state. In one example, the reference 3D point cloud can be retrieved from data store 178 from a plurality of reference 3D point clouds indexed by the angle of the bucket when the reference 3D point cloud was generated. After retrieving a reference 3D point cloud of empty bucket 108, volume generator logic 162 compares the generated 3D point cloud from block 530 to the reference point cloud to determine the volume of contents in bucket 108. For example, volume generator logic 162 subtracts the reference point cloud from the generated point cloud and the resulting difference is the volume. In another example, the volume for each point in the point cloud is determined, and then the volume for the points in bucket 108 are summed to compute the volume for the contents in bucket 108.

Figure 5B:
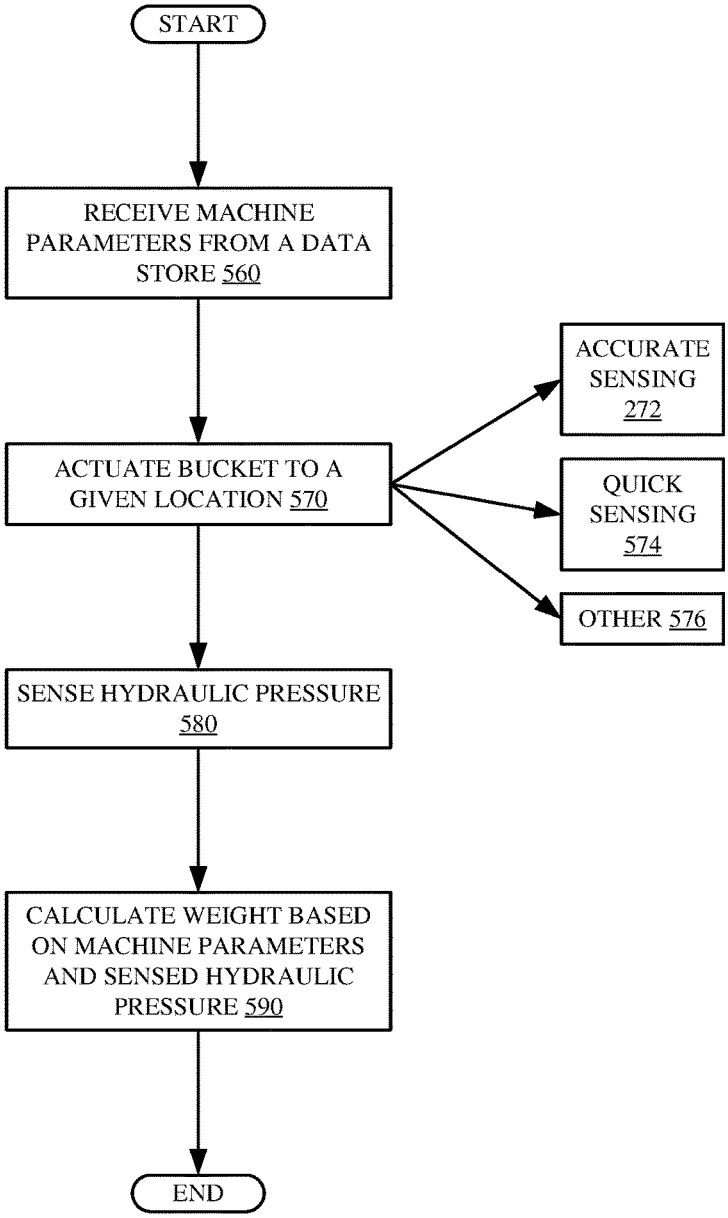
FIG. 5B is a flow diagram showing one example operation of a sensor sensing the weight of contents in bucket.

FIG. 5B is a flow diagram showing one example operation 550 of a sensor sensing the weight of contents in bucket 108. Operation 550 begins at block 560 where weight generator logic 164 retrieves machine parameters from data store 178. Machine parameters can include any values that will be used in calculating a weight of contents in bucket 108 based on a hydraulic pressure load on a pressure sensor 136. For example, machine parameters can include machine component weights, machine component geometries, etc.

At block 570, bucket 108 is actuated to a given location. As indicated by block 572, the location can be chosen based on its conduciveness to accuracy in sensing a weight of bucket 108 and its contents. For example, for some weighing sensor systems there are specific positions and movements of the bucket that allow for more accurate sensing. As indicated by block 574, the location can be chosen based on the ability to quickly sense a weight of bucket 108 and its contents. For instance, the location may be at a point along a regular dig cycle, such that bucket 108 only has to momentarily stop mid-dig cycle and then continue digging (as opposed to stopping the dig cycle and actuating bucket 108 to a sensing location, e.g. from block 572, and momentarily stopping bucket 108 at the sensing location and then returning back to the dig cycle). Of course, a different location may be chosen as well, as indicated by block 576. For instance, the location may be chosen by balancing the sensor accuracy against the quickness of sensing at a plurality of given points.

At block 580, pressure sensor 136 senses the hydraulic pressure on one of actuators 152. It could be any one of the actuators 152 from FIGS. 1 and 2. For example, the hydraulic pressure of actuator 114 coupled to boom 104 can be sensed.

At block 590, weight generator logic 164 calculates the weight of contents in bucket 108 based on the machine parameters (from block 560) and the sensed hydraulic pressure (from block 580). An example weight calculation is as follows:

$$\text{Content Weight} = \frac{\text{Total Pressure} - \text{Pressure Contribution by Machine Components}}{\text{Actuator Modifier} \times \text{Content Location Modifier}} \quad \text{Eq. 1}$$

Total pressure can be the pressure received at block 580. Pressure contribution by machine components is determined using the received machine parameters at block 560. As an example only, the pressure contribution of the components can be determined using the center of gravity locations of the components (bucket 108, stick 106, boom 104) relative to the fulcrum of the boom 104, and the weight of the components. The actuator modifier can be a machine parameter received at block 560. In one example, the actuator modifier is the inverse of the hydraulic piston effective area of the actuator 114 modified by the leverage advantage of actuator 114 on boom 104. The content location modifier accounts for the leverage advantage the weight of the contents has against the actuator. The location modifier can be based on a visual sensor value or estimated by knowing the location of bucket 108. For instance, the contents in bucket 108 may be some distance from boom 104 fulcrum and the leveraged advantage of the weight of the contents may be greater than the weight of the contents alone. The leveraged advantage may be determined and accounted for based on a location of the contents.

Figure 6:
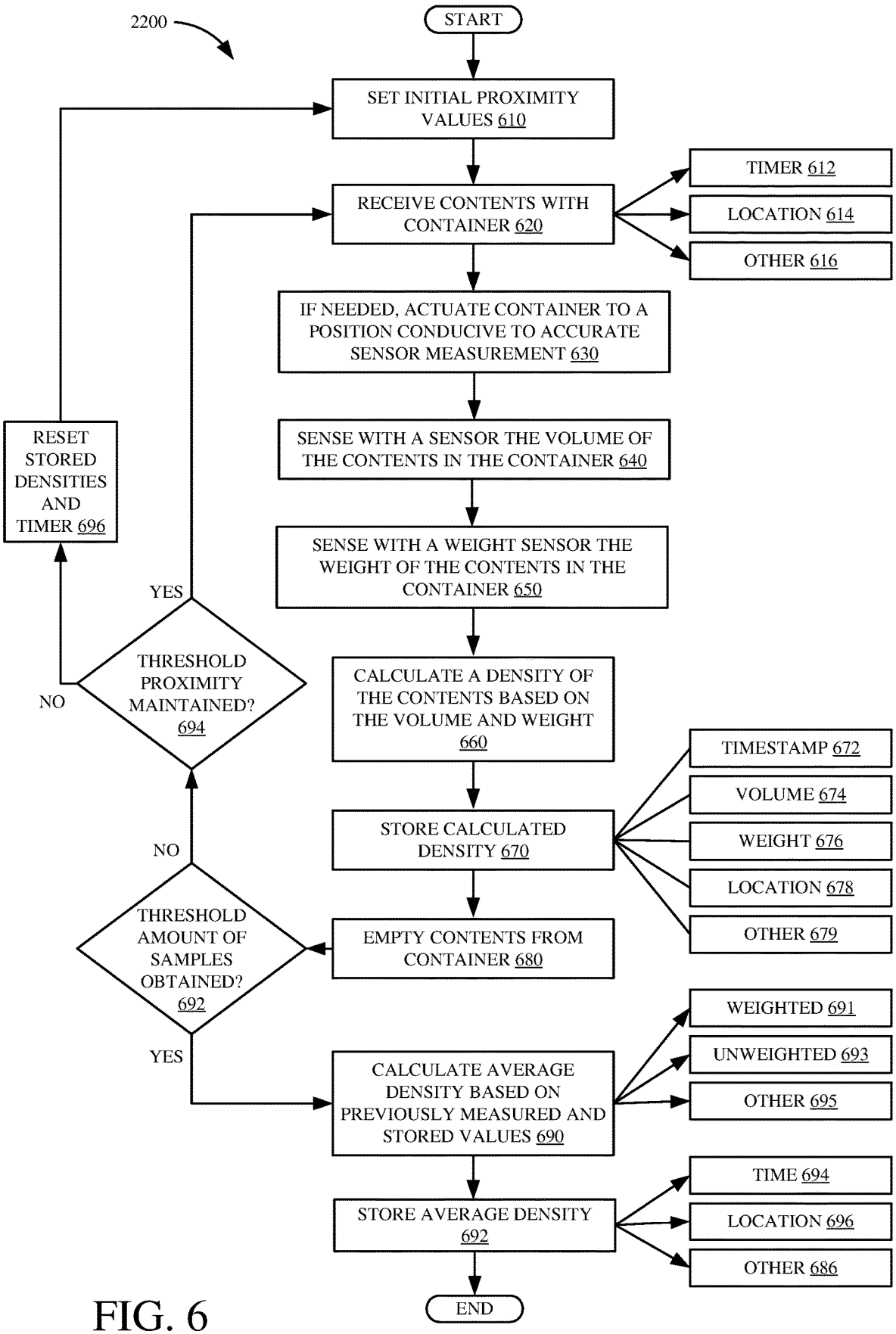
FIG. 6 is a flow diagram showing one example of a density calibration operation.

FIG. 6 is a flow diagram showing an operation 600 of density calibration. Operation 600 begins at block 610 where proximity logic 172 sets initial proximity values. As indicated by block 612, a proximity value may be time. For example, proximity logic 172 starts a timer or retrieves the current time. As indicated by block 614, a proximity value may be location. For example, proximity logic 172 retrieves the current location (e.g., GPS receiver, local triangulation, manually entered location, elevation, digging depth, etc.). There may be other proximity values as well, as indicated by block 616.

Operation 600 proceeds at block 620 where bucket 108 retrieves contents. For example, bucket 108 scoops a load of earth from worksite 100.

At block 630, if needed, bucket 108 is actuated to a position conducive to accurate sensor measurement. For instance, there may be positions where a weight or volume of the contents in bucket 108 are more accurately sensed. For example, when using an image sensor to sense the volume of contents in a bucket 108 there may be positions where the image sensor cannot see the contents of bucket 108 (e.g., the bucket angle obscures the view of the contents). In some cases, there is little difference between sensing accuracies from location to location, in which case, block 630, may not be not necessary. In one example, volume and weight sensors (sensed at blocks 640 and 650, respectively) have different positions conducive to accurate sensing, and in this case, block 630 may be repeated in between block 640 and 650.

At block 640, 3D sensor 134 (or another volume sensor) senses the volume of the contents in the bucket 108. An example of sensing the volume of contents in bucket 108 is described in greater detail with respect to FIG. 5A.

At block 650, pressure sensor 136 (or another suitable weight sensor) senses the weight of the contents in bucket 108. An example operation of sensing the weight of contents in bucket 108 is described in greater detail respect to FIG. 5B.

At block 660, density generator logic 166 calculates the density of the contents in bucket 108 based on the sensed volume (from block 640) and sensed weight (in block 650). In one example, density generator logic 166 simply divides the sensed weight by the sensed volume. In other examples, density generator logic 166 can use more complicated algorithms and utilize more inputs. For instance, weight of a material may be skewed by the moisture of the material, and in some applications, it may be desired to factor out the moisture to get an accurate amount of a dry product (e.g. precision concrete applications require a certain amount of water to be in the final mixed product).

At block 670, density generator logic 166 stores the calculated density in data store 178. Density generator logic 166 can store the density value with additional metadata, as indicated by blocks 672-679. As indicated by block 672, the density value may be stored in association with the time it was calculated. As indicated by block 674, the density value may be stored in association with the sensed volume value (e.g., from block 640). As indicated by block 676, the density value may be stored in association with the sensed weight value (e.g., from block 650). As indicated by block 678, the density value may be stored in association with the location where the metrics of the contents were measured.

At block 680, the contents are emptied from bucket 108. At block 682, metric averaging logic 170 determines whether a threshold number of samples (e.g., calculated density values) have been obtained. A threshold number of samples can be indicative of a number of samples required to get a reliable density average. The threshold number can be identified, pre-determined or dynamically calculated.

If the threshold number of samples have not been obtained, then operation 600 proceeds at block 694. At block 694, proximity logic 172 determines if a threshold proximity has been maintained. For example, if the machine is still operating within a threshold distance from previous places where densities were calculated. For instance, the location proximity may be 100 yards and if the machine is operating outside the 100-yard area, the proximity threshold is not maintained and operation 600 proceeds at block 696. Or for example, if a threshold amount of time has passed since the last densities were calculated. For instance, the time proximity may be a day, and if it has been longer than a day since the last density was calculated, the proximity threshold is not maintained and operation 600 proceeds at block 696. If the threshold proximity is maintained, then operation 600 proceeds at block 620 to obtain another density value. If the threshold proximity is not maintained, then operation 600 proceeds at block 696 where the stored densities and proximity thresholds are reset. After these values are reset, operation 600 proceeds at block 610 where new proximity threshold values are set.

Returning to block 682, if the threshold number of samples have been obtained, operation 600 proceeds at block 690. At block 690, metric averaging logic 170 retrieves the previously stored densities (e.g., from block 670) and calculates an average density. Metric averaging logic 170 can calculate an average based on weighting the previously obtained densities. For example, if there are ten density values to be averaged and nine of them were at a first location and the last remaining value was obtained at a location within the threshold but at a second location some distance away from the first location, its value could be reduced in contribution to the average density. Metric averaging logic 170 can calculate an average based on unweighted values, as indicated by block 693. For example, all of the calculated densities (from block 660) are added up and divided by the number of calculated densities. Metric averaging logic 170 can calculate an average in other ways as well, as indicated by block 695.

At block 692 the average density is stored in data store 178. The average density can be stored with various metadata or index by a corresponding value. As indicated by block 694, the average density can be stored with, or indexed by, a time of calculation. For instance, the time of calculation can be used during runtime (e.g., operation 300 in FIG. 3) to determine whether the average density needs to be recalculated as an "old" average density may no longer be representative of current densities. As indicated by block 696, the average density can be stored with, or indexed by, a location of calculation. For instance, the location of calculation being used during runtime (e.g., operation 300 in FIG. 3) to determine whether the average density needs to be recalculated because an average calculation in one location may not be representative of a second location material density. As indicated by block 698, the average density can be stored with, or indexed by, other values as well.

It will be noted that the above discussion has described a variety of different systems, components and/or logic. It will be appreciated that such systems, components and/or logic can be comprised of hardware items (such as processors and associated memory, or other processing components, some of which are described below) that perform the functions associated with those systems, components and/or logic. In addition, the systems, components and/or logic can be comprised of software that is loaded into a memory and is subsequently executed by a processor or server, or other computing component, as described below. The systems, components and/or logic can also be comprised of different combinations of hardware, software, firmware, etc., some examples of which are described below. These are only some examples of different structures that can be used to form the systems, components and/or logic described above. Other structures can be used as well.

Figure 7:
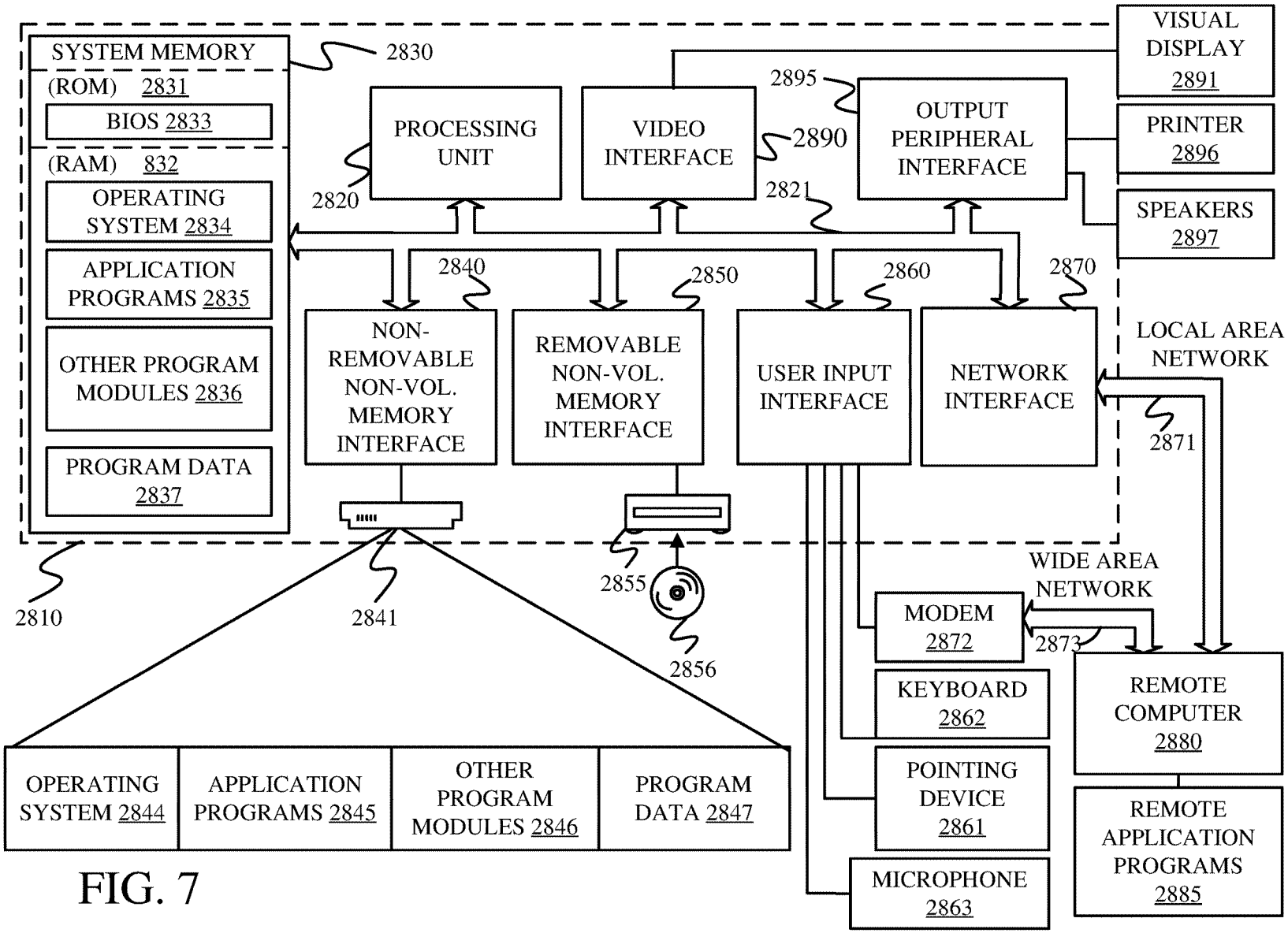
FIG. 7 is a block diagram showing one example of a computing environment.

FIG. 7 is one example of a computing environment in which elements of FIG. 2, or parts of it, (for example) can be deployed. With reference to FIG. 7, an example system for implementing some examples includes a general-purpose computing device in the form of a computer 2810. Components of computer 2810 may include, but are not limited to, a processing unit 2820 (which can comprise processor 154 or other processors or servers), a system memory 2830, and a system bus 2821 that couples various system components including the system memory to the processing unit 2820. The system bus 2821 may be any of several types of bus structures including a memory bus or memory controller, a peripheral bus, and a local bus using any of a variety of bus architectures. Memory and programs described with respect to FIG. 2 can be deployed in corresponding portions of FIG. 7.

Computer 2810 typically includes a variety of computer readable media. Computer readable media can be any available media that can be accessed by computer 2810 and includes both volatile and nonvolatile media, removable and non-removable media. By way of example, and not limitation, computer readable media may comprise computer storage media and communication media. Computer storage media is different from, and does not include, a modulated data signal or carrier wave. It includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 2810. Communication media may embody computer readable instructions, data structures, program modules or other data in a transport mechanism and includes any information delivery media. The term "modulated data signal" means a signal that has one or more of its characteristics set or changed in such a manner as to encode information in the signal.

The system memory 2830 includes computer storage media in the form of volatile and/or nonvolatile memory such as read only memory (ROM) 2831 and random-access memory (RAM) 2832. A basic input/output system 2833 (BIOS), containing the basic routines that help to transfer information between elements within computer 2810, such as during start-up, is typically stored in ROM 2831. RAM 2832 typically contains data and/or program modules that are immediately accessible to and/or presently being operated on by processing unit 2820. By way of example, and not limitation, FIG. 7 illustrates operating system 2834, application programs 2835, other program modules 2836, and program data 2837.

The computer 2810 may also include other removable/non-removable volatile/nonvolatile computer storage media. By way of example only, FIG. 7 illustrates a hard disk drive 2841 that reads from or writes to non-removable, nonvolatile magnetic media, an optical disk drive 2855, and nonvolatile optical disk 2856. The hard disk drive 2841 is typically connected to the system bus 2821 through a non-removable memory interface such as interface 2840 and optical disk drive 2855 are typically connected to the system bus 2821 by a removable memory interface, such as interface 2850.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (e.g., ASICs), Application-specific Standard Products (e.g., ASSPs), System-on-a-chip systems (SOCs), Complex Programmable Logic Devices (CPLDs), etc.

The drives and their associated computer storage media discussed above and illustrated in FIG. 7, provide storage of computer readable instructions, data structures, program modules and other data for the computer 2810. In FIG. 7, for example, hard disk drive 2841 is illustrated as storing operating system 2844, application programs 2845, other program modules 2846, and program data 2847. Note that these components can either be the same as or different from operating system 2834, application programs 2835, other program modules 2836, and program data 2837.

A user may enter commands and information into the computer 2810 through input devices such as a keyboard 2862, a microphone 2863, and a pointing device 2861, such as a mouse, trackball or touch pad. Other input devices (not shown) may include a joystick, game pad, satellite dish, scanner, or the like. These and other input devices are often connected to the processing unit 2820 through a user input interface 2860 that is coupled to the system bus, but may be connected by other interface and bus structures. A visual display 2891 or other type of display device is also connected to the system bus 2821 via an interface, such as a video interface 2890. In addition to the monitor, computers may also include other peripheral output devices such as speakers 2897 and printer 2896, which may be connected through an output peripheral interface 2895.

The computer 2810 is operated in a networked environment using logical connections (such as a local area network—LAN, or wide area network WAN) to one or more remote computers, such as a remote computer 2880.

When used in a LAN networking environment, the computer 2810 is connected to the LAN 2871 through a network interface or adapter 2870. When used in a WAN networking environment, the computer 2810 typically includes a modem 2872 or other means for establishing communications over the WAN 2873, such as the Internet. In a networked environment, program modules may be stored in a remote memory storage device. For example, that remote application programs 2885 can reside on a remote computer.

It should also be noted that the different examples described herein can be combined in different ways. That is, parts of one or more examples can be combined with parts of one or more other examples. All of this is contemplated herein.

Example 1 is a mobile work machine comprising:

a frame;

a ground engaging element movably supported by the frame and driven by an engine to drive movement of the mobile work machine;

a container movably supported by the frame, the container configured to receive contents;

an actuator configured to controllably drive movement of the container relative to the frame;

a control system configured to generate an actuator control signal, indicative of a commanded movement of the actuator, and provide the actuator control signal to the actuator to control the actuator to perform the commanded movement; and a content density determination system, communicatively coupled to the control system, configured to determine a density of the contents of the container.

Example 2 is the mobile work machine of claim 1, further comprising:

a volume sensor configured to generate a volume sensor signal;

volume generator logic configured to determine a volume of the contents in the container, based on the volume sensor signal; and wherein the content density determination system determines the density based on the volume of the contents.

Example 3 is the mobile work machine of any or all previous examples, further comprising:

a weight sensor configured to generate a weight sensor signal;

weight generator logic configured to determine a weight of contents in the container, based on the weight sensor signal; and wherein the content density determination system determines the density based on the weight of the contents.

Example 4 is the mobile work machine of any or all previous examples, wherein weight generator logic is configured to, in response to receiving an indication, indicative of a weight sensor malfunction, determine the weight of the contents based on a volume of the contents and a previously determined density of the contents.

Example 5 is the system of any or all previous examples, wherein volume generator logic is configured to, in response to receiving an indication, indicative of a weight sensor malfunction, determine the volume of the contents based on a weight of the contents and a previously determined density of the contents.

Example 7 is the mobile work machine of any or all previous examples, wherein the volume sensor comprises:

an image sensor configured to capture an image of the contents in the container of the work machine; and wherein the volume generator logic is configured to determine the volume of the contents in the container, based on the image.

Example 8 is the mobile work machine of any or all previous examples, wherein the image sensor comprises at least one of a stereo camera or a laser scanner.

Example 9 is the mobile work machine of any or all previous examples, wherein the container comprises a bucket, the mobile work machine comprises an excavator, and the contents comprise earth.

Example 10 is the mobile work machine of any or all previous examples, further comprising:

display generator logic configured to display the density of the contents in the container on a display device in a cab of the mobile work machine.

Example 11 is a mobile work machine control system, comprising:

control logic configured to generate an actuator control signal, indicative of a commanded movement of an actuator coupled to a container of the mobile work machine to controllably drive movement of the container of the mobile work machine, and provide the actuator control signal to the actuator to control the actuator to perform the commanded movement;

a content density determination system configured to determine an average density of contents in the container over a period of time;

a content estimation system configured to determine, based on the average density and a sensor signal from a container sensor, at least one of:

a current volume of current contents in the container; or a current weight of the current contents in the container.

Example 12 is the mobile work machine control system of any or all previous examples, wherein the container sensor comprises an image sensor configured to capture an image of the container, the image being, at least in part, indicative of the current volume of the current contents in the container.

Example 13 is the mobile work machine control system of any or all previous examples, wherein the container sensor comprises a weight sensor configured to detect a weight of the current volume of the current contents in the container.

Example 14 is the mobile work machine control system of any or all previous examples, comprising classifying logic configured to determine a type of current contents, based on the average density.

Example 15 is the mobile work machine control system of any or all previous examples, wherein the weight sensor comprises a hydraulic pressure sensor.

Example 16 is the mobile work machine control system of any or all previous examples, wherein the image sensor comprises at least one of a stereo camera or a laser scanner.

Example 17 is a method of controlling a mobile work machine comprising:

receiving, with a control system, an operator input indicative of a commanded movement of an actuator configured to drive movement of a container movably supported by a frame of the mobile work machine;

generating, with the control system, a control signal indicative of the commanded movement;

receiving, with weight generator logic and from a weight sensor, a weight of first contents in a container of a work vehicle;

receiving, with volume generator logic and from an image sensor, an image of the first contents in the container of a work vehicle;

determining, with volume generator logic, a volume of the first contents in the container, based on the image;

determining, with density generator logic, a density of the first contents in the container based on the weight and volume of the first contents.

Example 18 is the method of any or all previous examples, further comprising determining, with weight generator logic, a weight of second contents in the container based on the density of the first contents and a detected volume of the second contents.

Example 19 is the method of any or all previous examples, further comprising determining, with volume generator logic, a volume of second contents in the container based on the density of the first contents and a detected weight of the second contents.

Example 20 is the method of any or all previous examples, further comprising determining, with classifying logic, a type of the contents based on the density.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A mobile work machine comprising:

a frame;

a ground engaging element movably supported by the frame and driven by an engine to drive movement of the mobile work machine;

a container movably supported by the frame, the container configured to receive contents;

an actuator configured to controllably drive movement of the container relative to the frame;

a volume sensor configured to generate a volume sensor signal;

a weight sensor configured to generate a weight sensor signal; and a control system configured to:

generate an actuator control signal, indicative of a commanded movement of the actuator, and provide the actuator control signal to the actuator to control the actuator to perform the commanded movement; and determine a volume of a first contents in the container based on the volume signal;

determine a weight of the first contents in the container based on the weight signal;

determine a density of the first contents of the container based on the volume of the first contents in the container and the weight of the first contents in the container; and determine, based on the density of the first contents, at lease one of:

a weight of a second contents, different than the first contents, in the container; or a volume of the second contents in the container.

2. The mobile work machine of claim 1, wherein the control system is configured to, in response to receiving an indication, indicative of a weight sensor malfunction, determine the weight of the second contents based on a detected volume of the second contents and the density of the first contents.

3. The system of claim 1, wherein the control system logic is configured to, in response to receiving an indication, indicative of a volume sensor malfunction, determine the volume of the contents based on a detected weight of the second contents and the density of the first contents.

4. The mobile work machine of claim 1, wherein the volume sensor comprises:

an image sensor configured to capture an image of the contents in the container of the work machine; and wherein the control system is configured determine the volume of the contents in the container, based on the image.

5. The mobile work Machine of claim 4, wherein the image sensor comprises at least one of a stereo camera or a laser scanner.

6. The mobile work machine of claim 1, wherein the container comprises a bucket, the mobile work machine comprises an excavator, and the contents comprise earth.

7. The mobile work machine of claim 1, further comprising:

a display generator logic configured to display the density of the contents in the container on a display device in a cab of the mobile work machine.

8. A mobile work machine control system, comprising:

control logic configured to generate an actuator control signal, indicative of a commanded movement of an actuator coupled to a container of the mobile work machine to controllably drive movement of the container of the mobile work machine, and provide the actuator control signal to the actuator to control the actuator to perform the commanded movement;

a content density determination system configured to determine an average density of contents in the container over a period of time; and a content estimation system configured to determine, based on the average density and a sensor signal from a container sensor, at least one of:

a current volume of current contents in the container; or a current weight of the current contents in the container.

9. The mobile work machine control system of claim 8, wherein the container sensor comprises an image sensor configured to capture an image of the container, the image being, at least in part, indicative of the current volume of the current contents in the container.

10. The mobile work machine control system of claim 8, wherein the container sensor comprises a weight sensor configured to detect a weight of the current contents in the container.

11. The mobile work machine control system of claim 8, comprising classifying logic configured to determine a type of current contents, based on the average density.

12. The mobile work machine control system of claim 10, wherein the weight sensor comprises a hydraulic pressure sensor.

13. The mobile work machine control system of claim 9, wherein the image sensor comprises at least one of a stereo camera or a laser scanner.

14. A method of controlling a mobile work machine comprising:

receiving, with a control system, an operator input indicative of a commanded movement of an actuator configured to drive movement of a container movably supported by a frame of the mobile work machine;

generating, with the control system, a control signal indicative of the commanded movement;

receiving, with a weight generator logic and from a weight sensor, a weight of a first contents in a container of a work vehicle;

receiving, with a volume generator logic and from an image sensor, an image of the first contents in the container of a work vehicle;

determining, with the volume generator logic, a volume of the first contents in the container, based on the image;

determining, with a density generator logic, a density of the first contents in the container based on the weight and volume of the first contents; and determining, with the with the weight generator logic, a weight of a second contents in the container, based on density of the first contents and a detected volume of the second contents.

15. The method of claim 14, further comprising determining, with the volume generator logic, a volume of a third contents in the container based on the density of the first contents and a detected weight of the third contents.

16. The method of claim 14, further comprising determining, with classifying logic, a type of the contents based on the density.

* * * * *